US010016021B2

(12) United States Patent
Drage

(10) Patent No.: US 10,016,021 B2
(45) Date of Patent: Jul. 10, 2018

(54) RELEASABLE INTERLOCKING FASTENING DEVICE FOR ATTACHING ADJACENT PARTS

(71) Applicant: Michael Robert Drage, Shrewsbury (GB)

(72) Inventor: Michael Robert Drage, Shrewsbury (GB)

( * ) Notice: Subject to any disclaimer, the term of this patent is extended or adjusted under 35 U.S.C. 154(b) by 131 days.

(21) Appl. No.: 14/898,453

(22) PCT Filed: Jun. 13, 2014

(86) PCT No.: PCT/GB2014/000235
§ 371 (c)(1),
(2) Date: Dec. 14, 2015

(87) PCT Pub. No.: WO2014/199116
PCT Pub. Date: Dec. 18, 2014

(65) Prior Publication Data

US 2016/0135550 A1 May 19, 2016

(30) Foreign Application Priority Data

Jun. 13, 2013 (GB) ..... 1310580.4

(51) Int. Cl.
*A44B 17/00* (2006.01)
*A44C 3/00* (2006.01)

(52) U.S. Cl.
CPC ..... *A44B 17/0041* (2013.01); *A44B 17/0023* (2013.01); *A44B 17/0076* (2013.01); *A44C 3/001* (2013.01); *A44B 17/007* (2013.01)

(58) Field of Classification Search
CPC ... A44B 1/34; A44B 17/0023; A44B 17/0076; A44B 17/0029; A44B 17/0035; A44B 17/0041; A44B 17/0064; A44B 17/007; A44C 3/001
See application file for complete search history.

(56) References Cited

U.S. PATENT DOCUMENTS

| | | | | |
|---|---|---|---|---|
| 1,096,897 A * | 5/1914 | Fisher | A44B 17/0029 24/624 |
| 1,604,913 A | 12/1924 | Hattingberg | |
| 1,733,650 A | 10/1929 | Cummings | |
| 1,775,042 A | 9/1930 | Lemoine | |
| 1,891,637 A | 12/1932 | Frank | |
| 2,118,561 A | 4/1936 | Kleeberg | |
| 2,041,506 A | 5/1936 | Woolson | |
| 2,041,606 A | 5/1936 | Hofmann | |
| 2,246,852 A * | 6/1941 | Kale | A44B 17/0041 24/666 |

(Continued)

FOREIGN PATENT DOCUMENTS

| | | |
|---|---|---|
| EP | 1634508 | 3/2006 |
| FR | 864346 | 4/1941 |

(Continued)

*Primary Examiner* — Jack W Lavinder

(57) ABSTRACT

A releasable interlocking device includes a pair of interactive plates, for fastening to apparel utilizing a system of two interactive pistes which when slid together diagonally utilizes the thickness of the apparel and, stud of a male plate to engage through a single angled flexible vane or lip to snap fit and lock over a solid edge of a female plate without damage to the aforesaid apparel.

11 Claims, 12 Drawing Sheets

(56) References Cited

U.S. PATENT DOCUMENTS

| | | | | |
|---|---|---|---|---|
| 2,497,305 | A | | 2/1950 | Isaac et al. |
| 2,647,261 | A | | 8/1953 | Rassner |
| 2,685,690 | A | | 8/1954 | Chrisman |
| 2,863,197 | A | | 12/1958 | Statham |
| 2,969,574 | A | | 1/1961 | Blake |
| 2,981,992 | A | | 5/1961 | Jawoll |
| 3,010,169 | A | | 11/1961 | Carpinella |
| 3,094,757 | A | | 6/1963 | Blake |
| 3,416,200 | A | | 12/1968 | Daddona, Jr. |
| 3,720,982 | A | | 3/1973 | Myers et al. |
| 4,007,515 | A | | 2/1977 | Agnelli |
| 4,242,886 | A | | 1/1981 | Tucker |
| 4,392,279 | A | | 7/1983 | Schwager |
| 4,875,237 | A | | 10/1989 | Cohen |
| 4,959,890 | A | | 10/1990 | Pazurek |
| 4,970,766 | A | | 11/1990 | Hsiau et al. |
| 5,113,553 | A | * | 5/1992 | Hutchinson ..... A44B 17/0029 24/108 |
| 5,115,548 | A | | 5/1992 | Nysten |
| 5,299,324 | A | | 4/1994 | Zinna |
| 5,581,815 | A | | 12/1996 | Hans |
| 6,266,853 | B1 | | 7/2001 | Ho |
| 6,408,444 | B1 | | 6/2002 | Zinna |
| 6,527,615 | B1 | | 3/2003 | Boehler |
| 6,568,044 | B1 | | 5/2003 | Kidd |
| 7,788,772 | B2 | | 9/2010 | Dandurand |
| 8,595,867 | B1 | | 12/2013 | Zinna |
| 9,320,326 | B2 | | 4/2016 | Greenspoon |
| 2006/0230583 | A1 | | 10/2006 | Chen |
| 2008/0147116 | A1 | | 6/2008 | Smith et al. |
| 2011/0041295 | A1 | | 2/2011 | Reiter |

FOREIGN PATENT DOCUMENTS

| | | | | | |
|---|---|---|---|---|---|
| FR | 1350098 | | | 1/1964 | |
| GB | 850884 | A | * | 10/1960 | ..... A44B 17/0052 |
| GB | 951000 | | | 3/1964 | |
| JP | 007042327 | Y2 | * | 10/1995 | ..... A44B 17/00 |
| JP | 200518964 | | | 7/2005 | |
| NL | 6611411 | | | 8/1966 | |

* cited by examiner

RELEASABLE INTERLOCKING FASTENING DEVICE FOR ATTACHING ADJACENT PARTS

The present invention relates generally to fasteners and more particularly to fasteners comprising of two halves which join one material to another without piercing the material to which they are affixed. Such fasteners are well known in the prior art, but not well known in the market place, particularly in the field of sporting events such as running, cycling, dancing and game show events where competitors and participants are required to affix an identification number supplied by the event organiser to their apparel. Such apparel and numbers may comprise of many varied materials including cotton, nylon and, in the case of displaying numbers, a lightweight paper-based material. It is well-known that in this circumstance the traditional, typical fastening method is via a standard pin, or standard safety pin attached to the four corners of a number and pushed through to pierce the participant's apparel twice to secure in place.

With the development of more sophisticated and expensive sports apparel to meet the needs of the modern recreational and elite athlete, coupled with a rising popularity of mass participation sporting events, often highly competitive, the design of the connecting interface between the participant's mandatory identification event number and the participant's apparel has not advanced; safety pins are still the usual method of attaching numbers.

It is well known that there exists a bell for multi-sport which can have an identification number affixed to it such that when the number is facing rearwards it is suitable for the bike leg of the event and when the belt is swivelled 180 degrees around the waist to the front of an athlete's body it can then be suitable for the run leg of a duathlon or a triathlon for example. However, such belts are expensive and only facilitate the connection of a number along the tap edge, not including the bottom edge, rendering inconsistent visibility and recognition of the aforesaid number during an event, especially in windy conditions with the tendency to flap about.

These commonplace connection systems have drawbacks as outlined above. Furthermore, by resorting to safety pins the athlete needs to pierce an expensive skin suit, expensive all in one tri-suit, or charity running vest, or expensive outfit in a dance or game show scenario, for example, and contend with the possible damage to the apparel as a result of holes made with the pin and repetitive holes made over time and the tearing which may take place during detachment. Indeed safety pins constitute a danger for the safety of the athlete, in case of their accidental opening, following, for example, an athlete's fall off the bike or a trip on the run.

The object of the present invention is to provide a system for fastening an event identification number on an athlete's apparel which overcomes the drawbacks manifested with the deployment of devices of known type.

A further object of the present invention is to realise a system for fastening a competition, or participation, event identification number on the apparel worn by an athlete without the need for stitching or other operations which may damage the material of the apparel.

A still further object of the present invention is to compare and contrast the invention with a device as described in EP1634508, which purports to solve the problems manifested above and which will be proven unlikely to be fit for purpose as expounded in the embodiments herein, particularly in regard to allowances being made to securely connect different thicknesses of apparel and the uncertainty of knowing whether or not the fastener has indeed fastened.

In accordance with aspects of the present invention there is provided a releasable interlocking device for fastening a plurality of athletes' apparel utilising a system of interactive plates in which a first part of a fastening system comprises of a female plate featuring a central orifice shaped internally with offset flexible vanes or lips opposing a single non-flexible vane or lip in which a second part of a fastening system comprises of a male plate featuring an integral stud and overlapping domed head or cap on top of the stud which pushes diagonally through a plurality of apparel to the central orifice deforming and engaging the flexible vane or lip of the first female plate and locking the stud head or cap together with a plurality of apparel over the solid vane or lip without piercing, or damage to, the apparel.

In a preferred embodiment a fastening device is formed of two halves, a specially designed male plate and a specially designed female plate, both configured in such a manner that the form of the male plate locks into the orifice of the female plate.

In order to attach an identification number to an athlete's apparel a stud integral with the male plate pushes the fabric on the inside surface of the apparel through a hole in the event identification number (most event numbers have four holes positioned in the four corners). The female plate is then offered up to the stud which penetrates preferably in a diagonal movement an orifice in the female plate which snap fits over the head of the exposed stud, with the apparel tightly sleeved on together with the event identification number, thereby locking the stud of the male plate to the female plate preventing them from separating without being physically released.

Preferably the fastening device allows for the thickness of any modern sports apparel.

A further embodiment of the invention wherby the male and female plates are linked via a hinge and could be any shape or be integrated with a device e.g. a nurses watch or form of identification e.g. for conferences and exhibitions or an object e.g. a poppy, or flower.

In order that the nature of the invention may be clearly understood an embodiment will now be described, by way of example only, together with accompanying drawings, with reference to providing a method for securing two or more materials together, preferably an athlete's or participant's or competitor's apparel and event identification number, without piercing or damaging the apparel to which it is attached.

Figure 1:
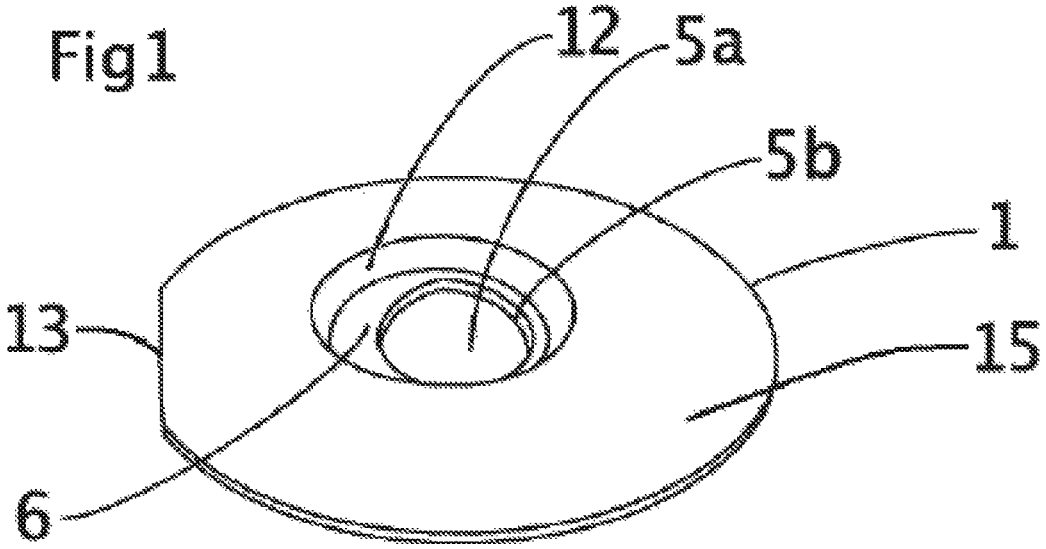
FIG. 1 depicts an isometric projection view of the outside surface and securing orifice of a connecting female plate in accordance with aspects of the present invention.
Figure 2:
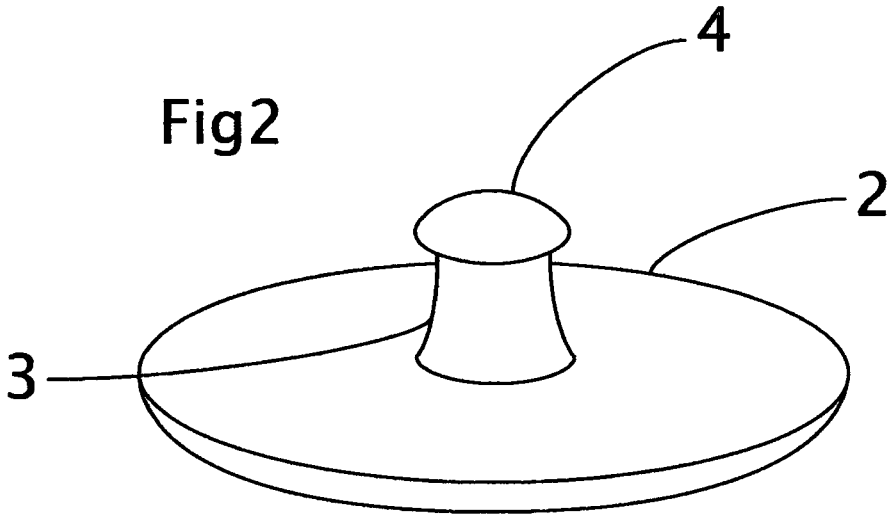
FIG. 2 depicts an isometric projection view of the inside surface and securing mechanism of a connecting male plate in accordance with aspects of the present invention.
Figure 4A:
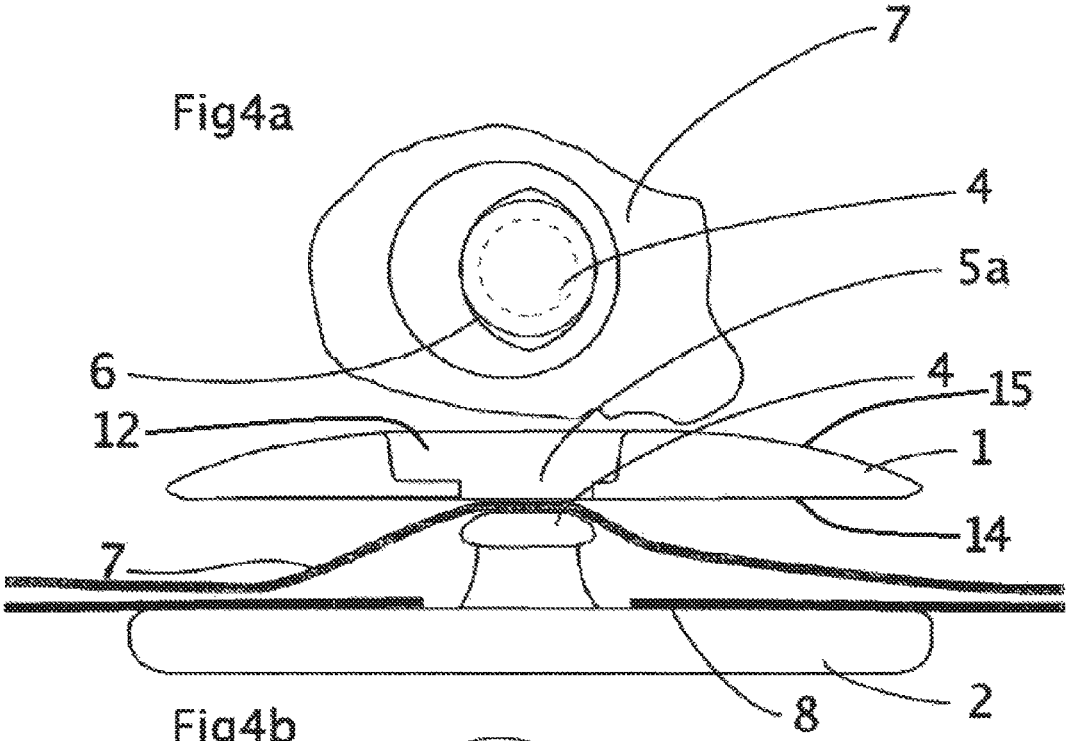

FIG. 4*a* depicts a third angle projection showing a top plan and cross sectional view of FIGS. 1 and 2 with the stud head of a male plate enveloped by fabric from a competitor's or participant's apparel offered up to the hole in the event identification number and orifice of the female plate in accordance with aspects of the present invention.

Figure 4B:
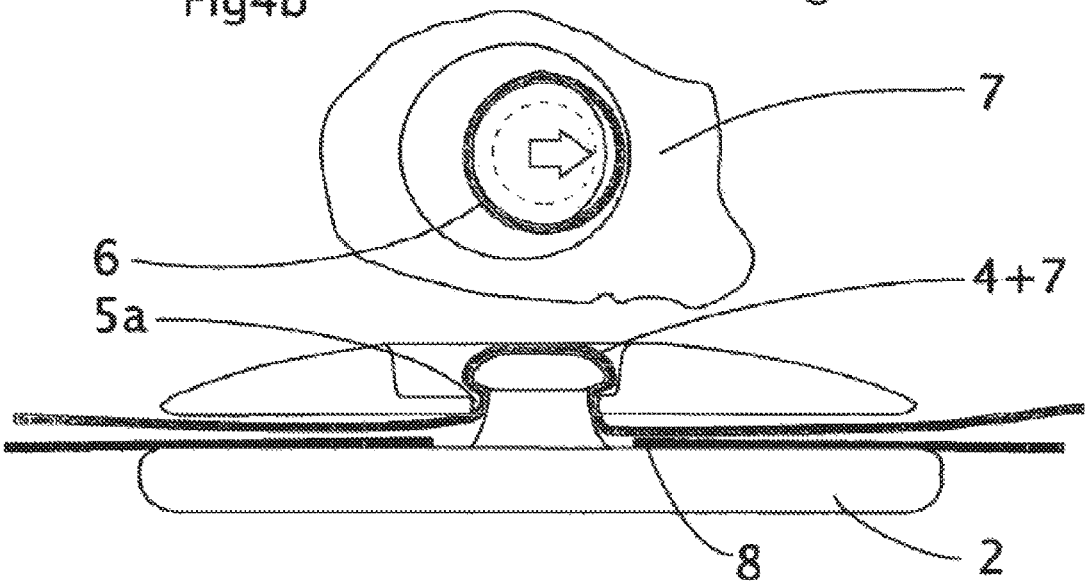

FIG. 4*b* depicts a third angle projection showing a top plan and cross sectional view of FIGS. 1 and 2 with the stud head of a male plate snap-fitted into the orifice of a female plate by means of guidance under friction by vanes, or lips, in the direction of the arrow, thus securing in place an event identification number to a competitor's or participant's apparel in accordance with aspects of the present invention.

Figure 5:
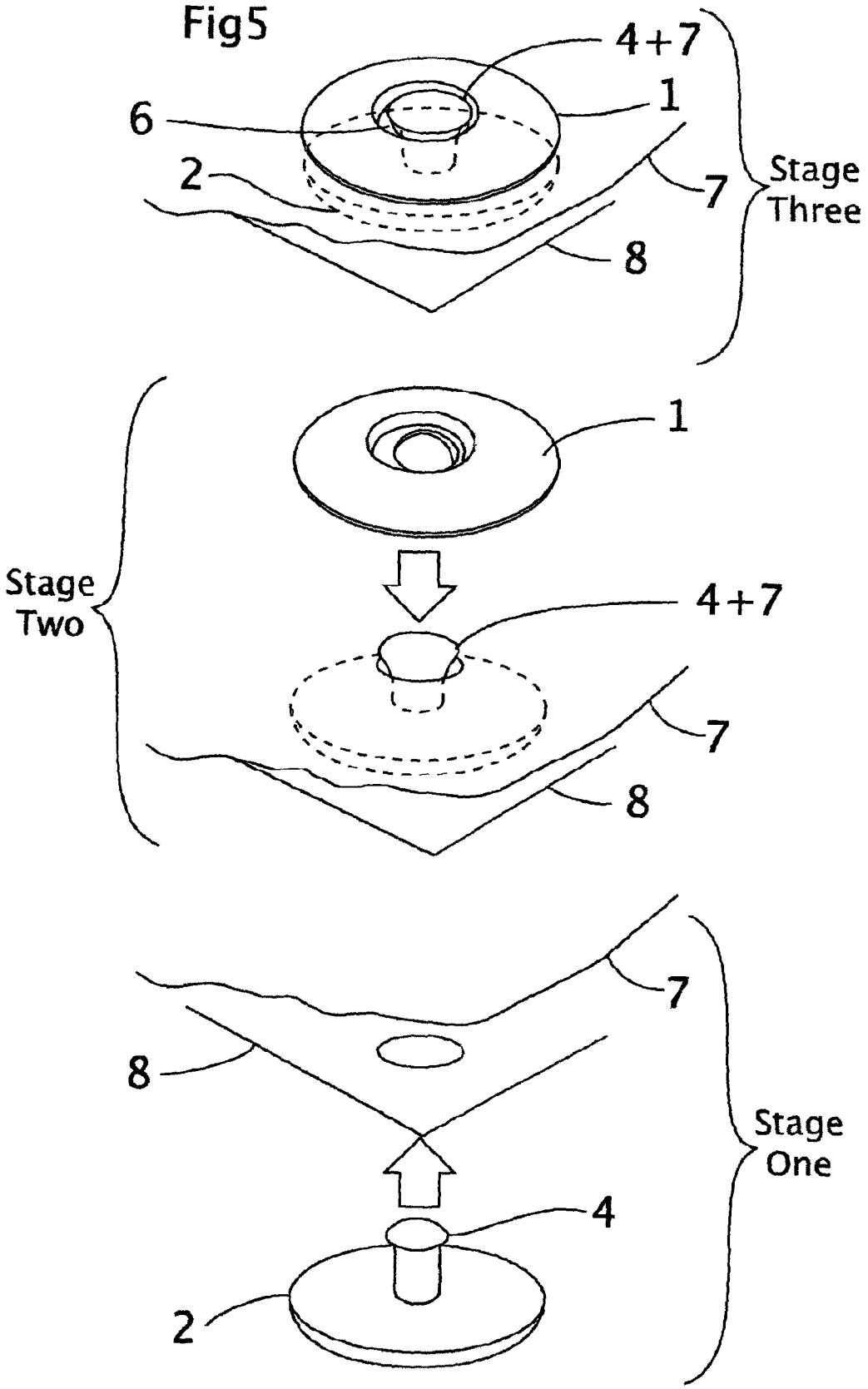

FIG. 5 depicts detailed exploded isometric projection views showing the assembly sequences of stage one stage two and stage three of a preferable interlocking fastening device in accordance with aspects of the present invention.

Figure 5A:
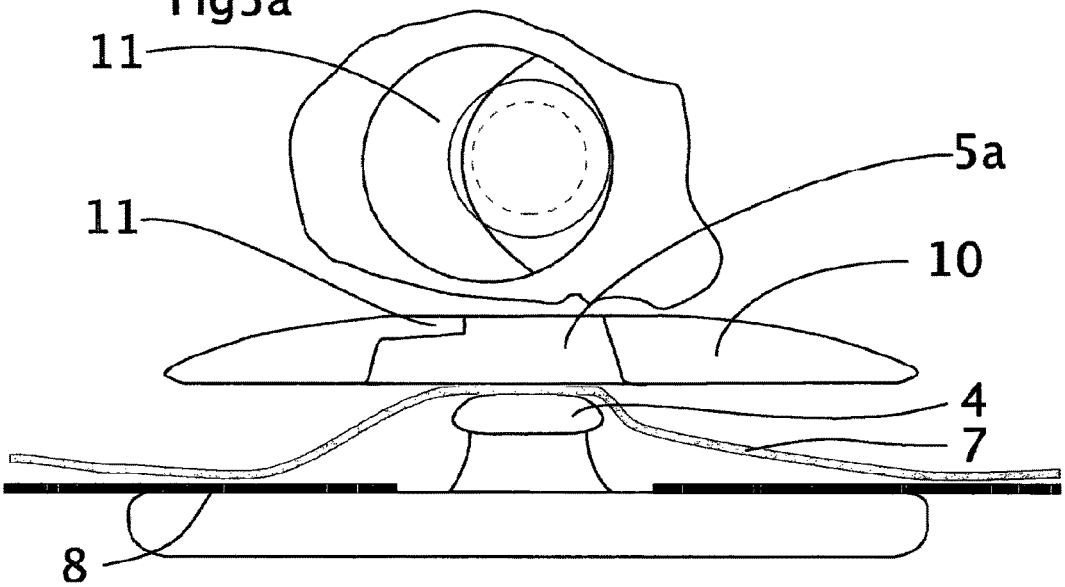

FIG. 5*a* depicts a third angle projection showing a top plan and cross sectional view of an alternative embodiment with the stud head of a male plate enveloped by fabric from a competitor's or participant's apparel offered up to the hole in the event identification number and orifice of the female plate in accordance with aspects of the present invention.

Figure 5B:
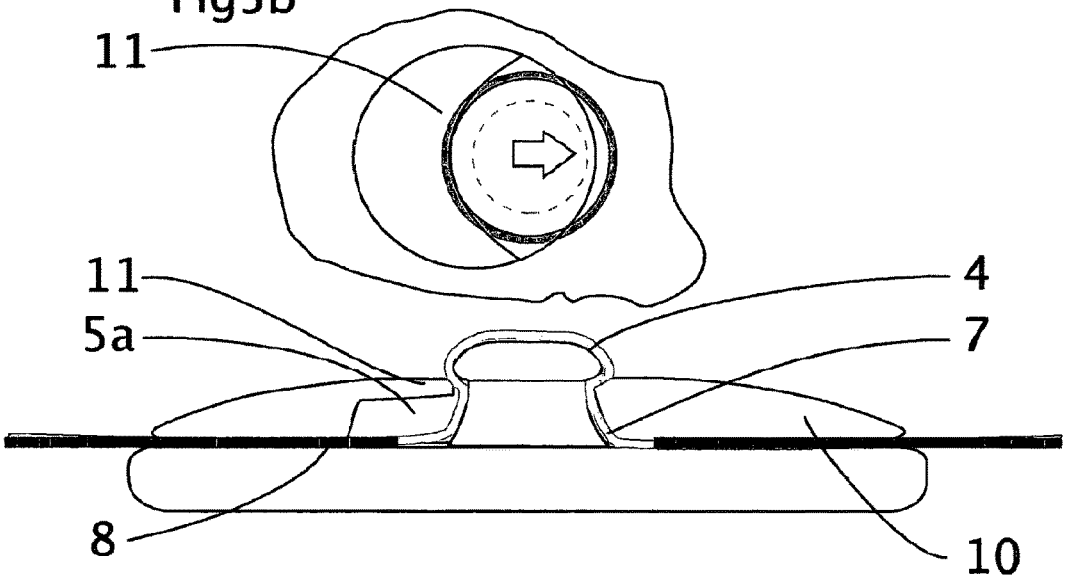

FIG. 5*b* depicts a third angle projection showing a top plan and cross sectional view of an alternative embodiment with the stud head of a male plate snap-fitted into the orifice of a female plate by means of guidance under friction by vanes, or lips, in the direction of the arrow, thus securing in place an event identification number to a competitor's or participant's apparel in accordance with aspects of the present invention.

Figure 6:
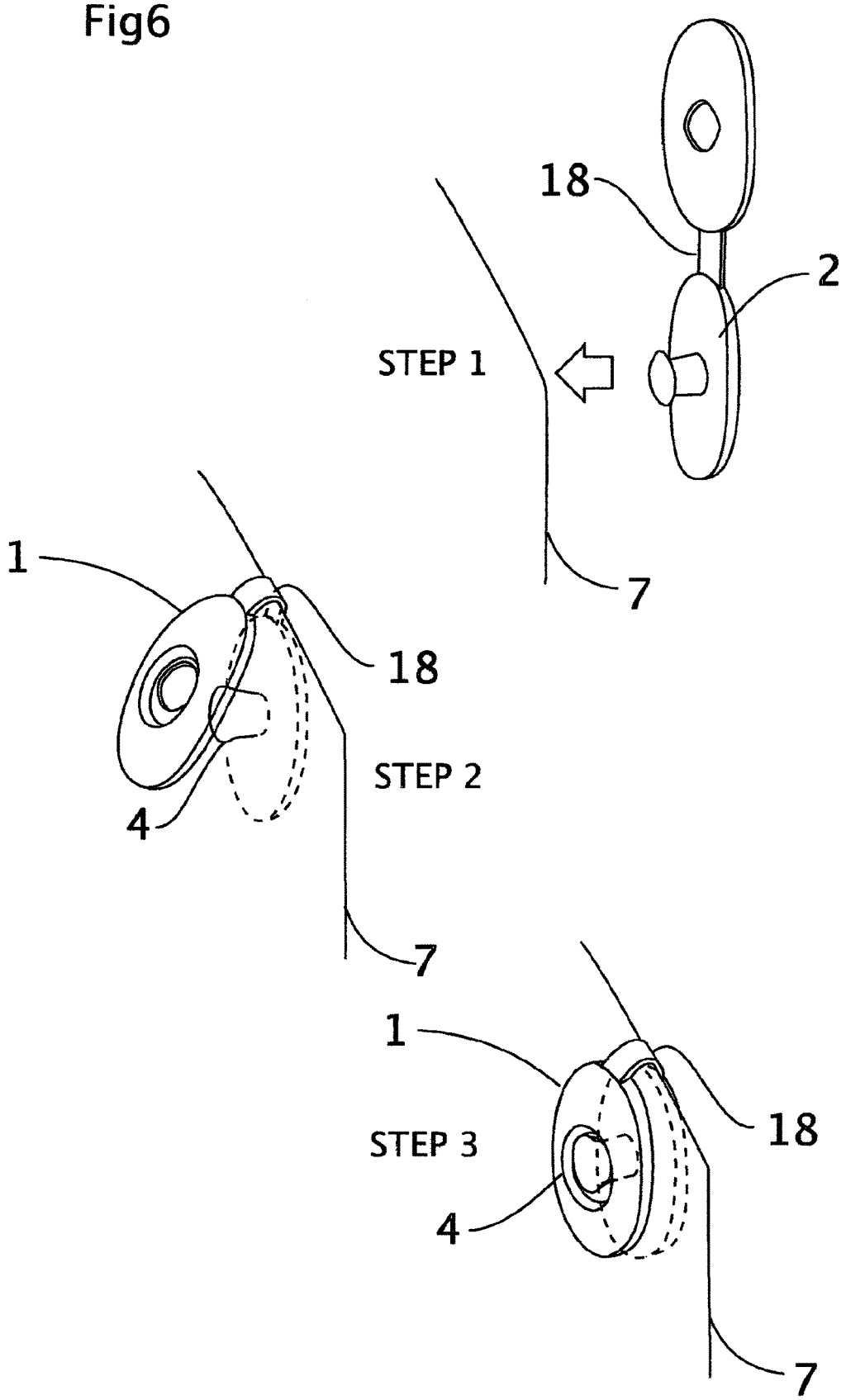

FIG. 6 depicts an isometric projection view of the three stages of operation to securing 2 flat sheet materials together close to their edges whereby the male and female plates are permanently connected by a flexible link in accordance with aspects of the present invention.

Figure 7:
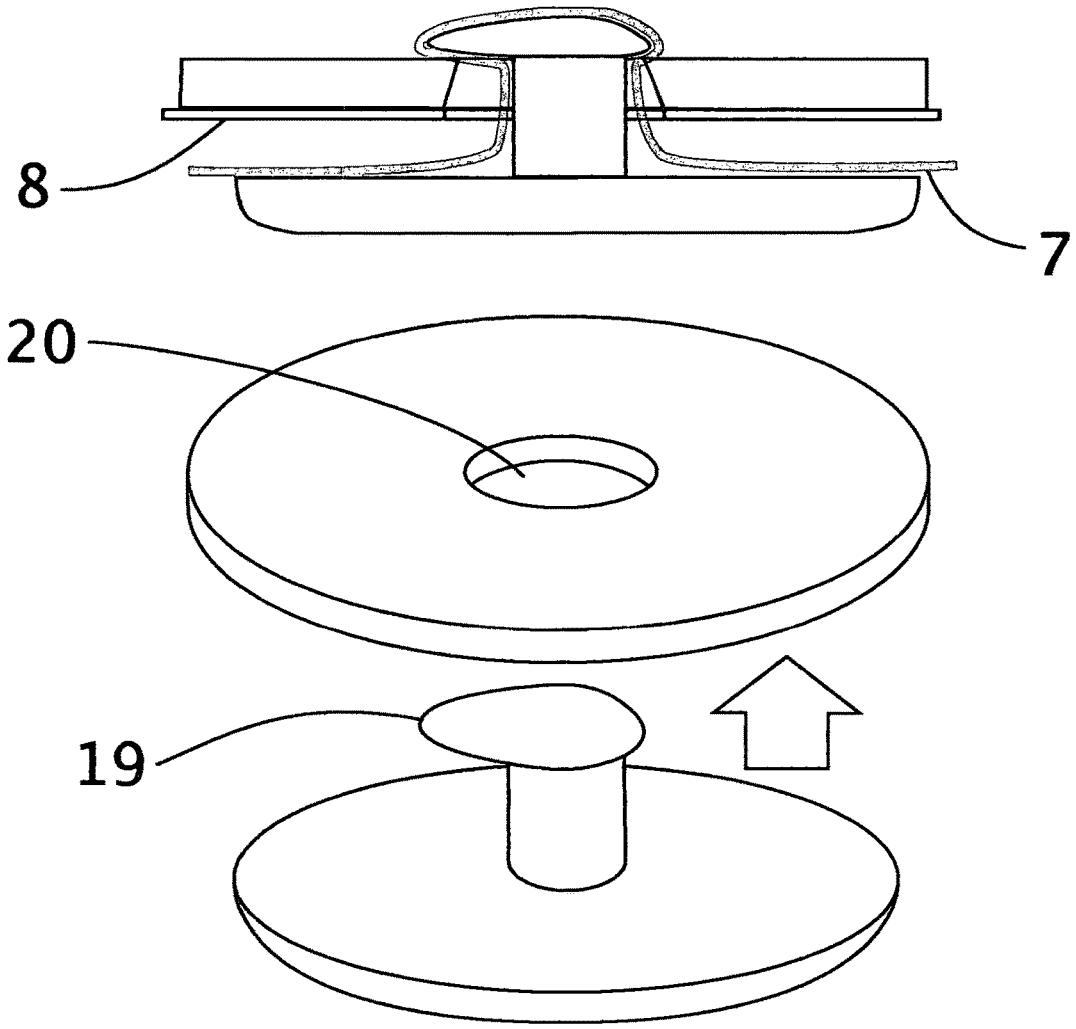

FIG. 7 depicts the assembly of an alternative embodiment of a male and female plate in accordance with aspects of the present invention whereby the orifice is circular in the female plate and the stud head of the male plate is elliptical which deforms and flexes when engaged with the orifice in the female plate in accordance with aspects of the present invention.

Figure 8:
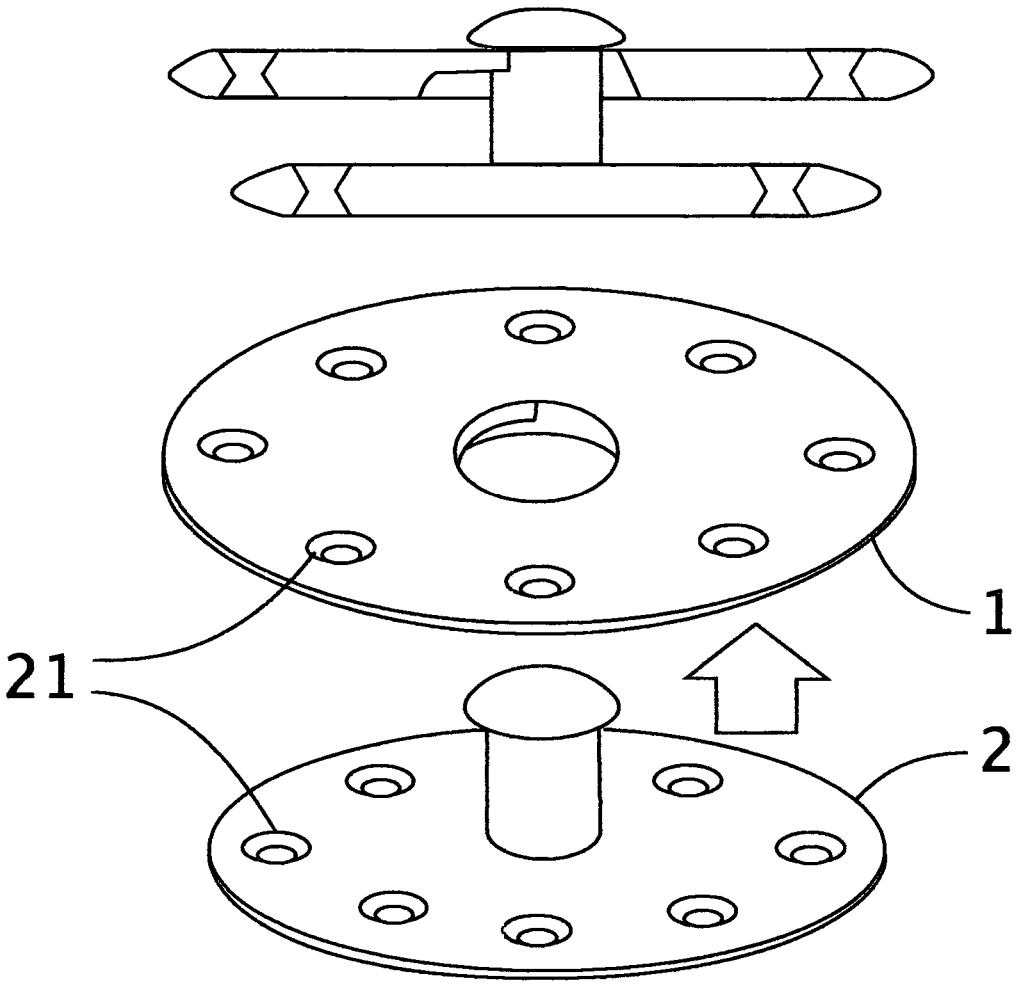

FIG. 8 depicts the assembly of a further alternative embodiment of a male and female plate where by the male and female plates can be attached to fabric or other materials in accordance with aspects of the present invention.

Figure 9:
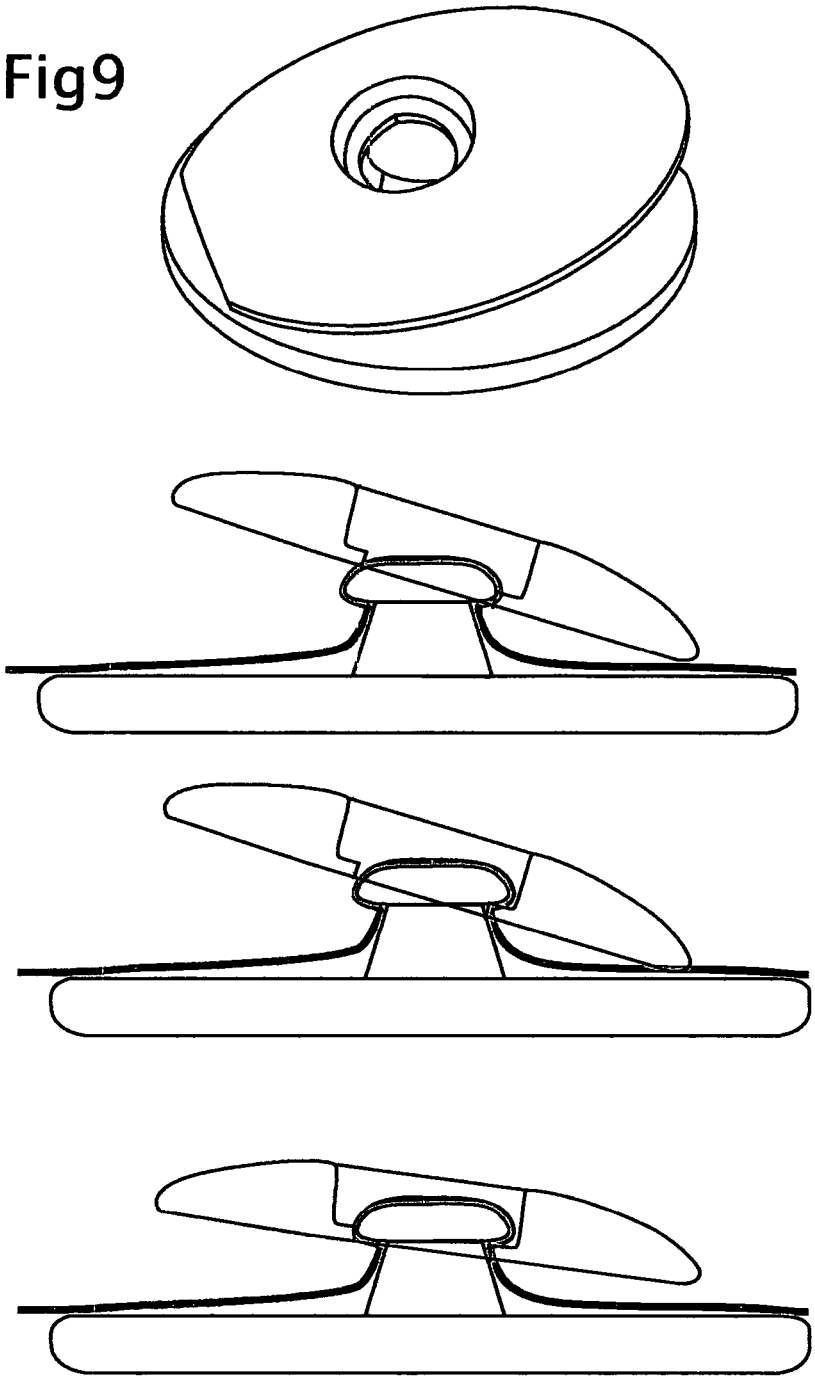

FIG. 9 depicts an example of a hinged angular method of engaging and releasing the two connecting plates in accordance with aspects of the present invention.

Figure 10:
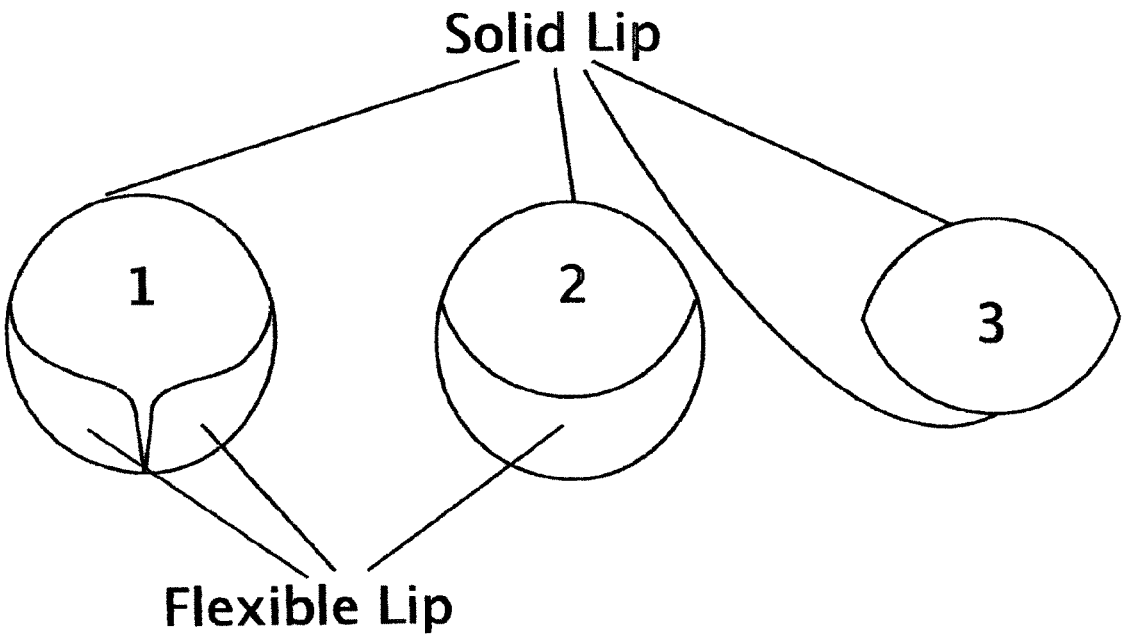

FIG. 10 depicts schematic drawings showing three variations of connecting orifices for the female plate in accordance with aspects of the present invention.

Figure 11:
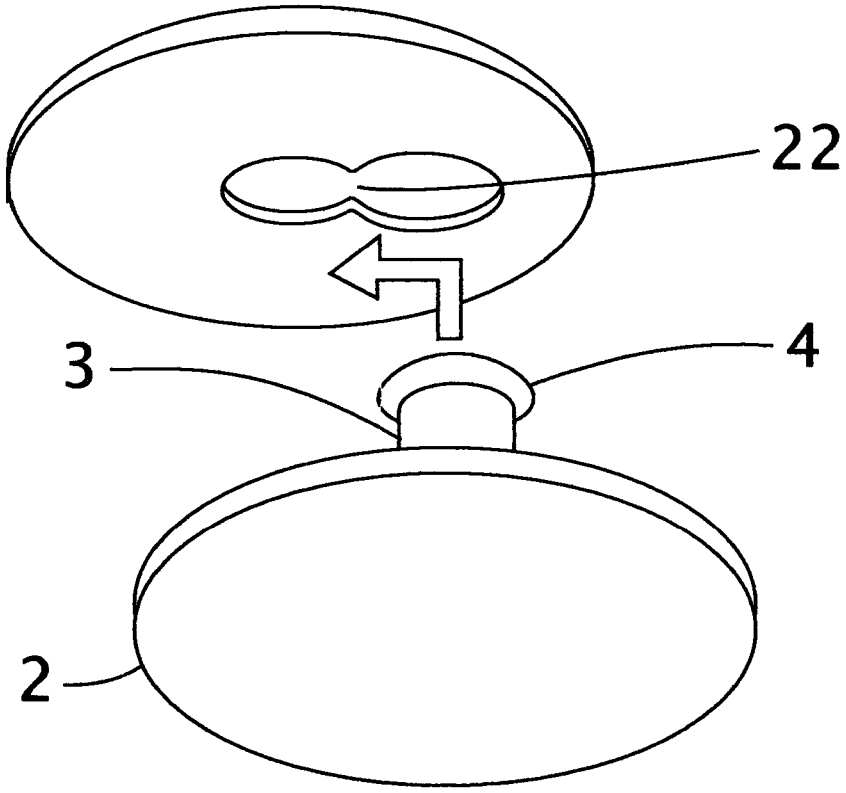

FIG. 11 depicts the assembly of a further alternative embodiment of a male and female plate where by the female plates orifice comprises 2 connected circular holes 1 of which is smaller and the other larger than the stud head of the male plate in accordance with aspects of the present invention.

In FIG. 1 the isometric projection of a female plate 1 is depicted typically comprising an offset elliptically shaped orifice 5*a* with parallel narrow ledge 5*b* traversing the inside perimeter of the central recess 12 in the plate until it meets the offset flexible lip 6 which is characterised by having a more substantial ledge. Featured on the outside surface can be a form of identification, which is typically molded into the surface, or printed on the surface, or molded in relief. It will be appreciated that such a plate in FIG. 1 may be of any shape, but according to aspects of the present invention preferably circular with a flat chord segment 13 across the perimeter.

In FIG. 2 molded at right angles to the inside surface of a male plate 2 and typically positioned in its centre, is a tapered stud 3, on the end of which features an overlapping hemi-spherical head 4, which may be partly domed. Such a plate may be of any shape.

Figure 3:
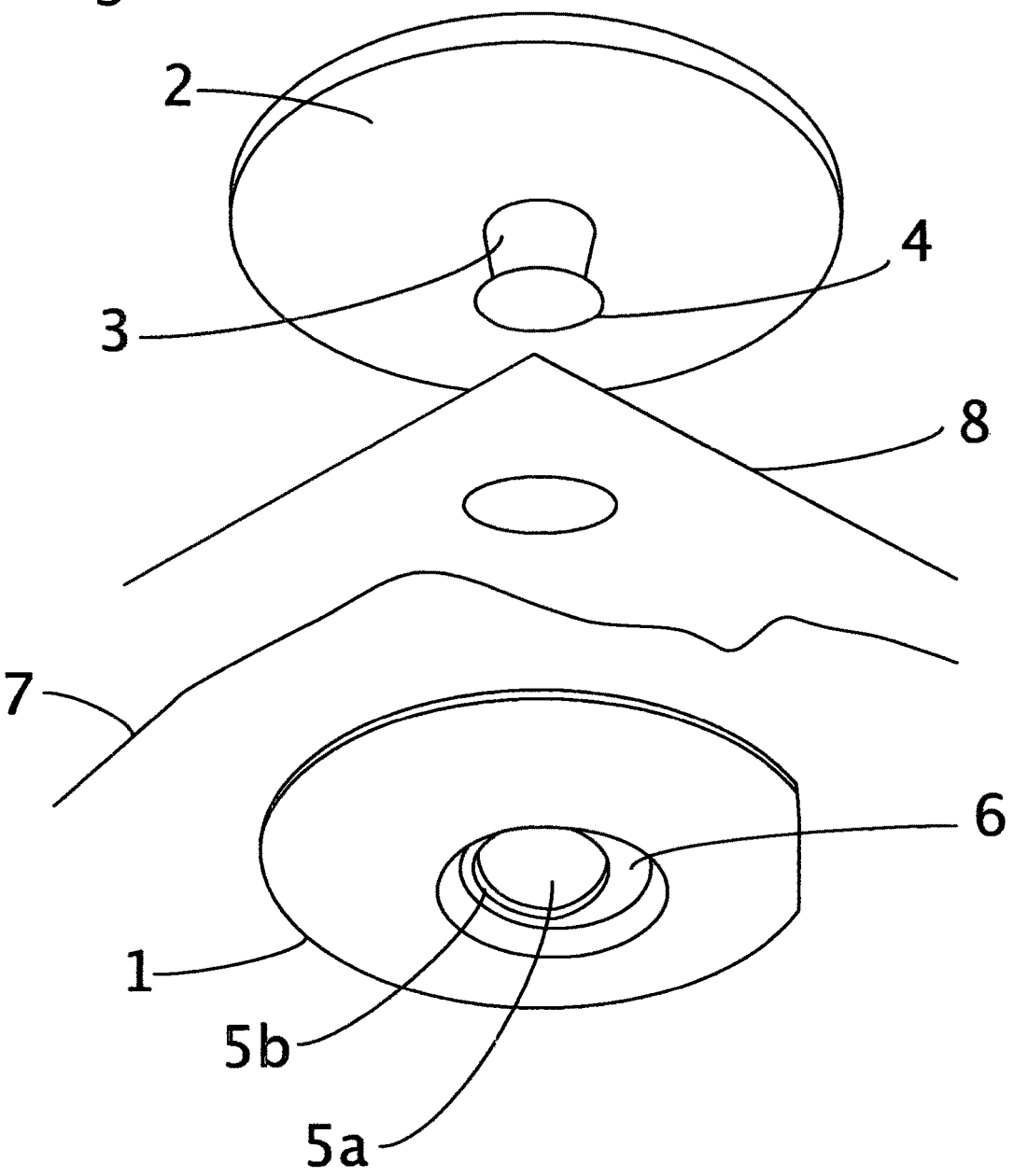
FIG. 3 depicts an exploded isometric projection view of the assembly of FIGS. 1 and 2 together with an event identification number and a competitors or participant's apparel in accordance with aspects of the present invention.

In FIG. 3 an exploded assembly is depicted whereby female plate 1 is shown positioned inside clothing apparel 7. In order to push and lock male plate 2 into plate 1 and thus secure the identification number 8. Stud 3 is pushed through a typical hole in the identification number 8 before being offered up against the aforementioned apparel 7. As a result stud 3 with apparel sleeved over it becomes exposed ready for female plate 1 to snap-fit over head 4 to secure the event identification number by locking into orifice 5*a* with offset non-flexible edge 5*b*, by means of offset flexible lip or vanes 6 molded around the inside surface of the said orifice in a preferred embodiment.

In FIG. 4 (*a*) the orthographic projection of the preferred embodiment referred to in FIG. 3 consists of an orifice Sa. Lip or vanes 6 which could be separated by a slot equispaced between them to allow greater flexibility of the plastic material when stud head 4 is offered up to penetrate and glide at an angle consistent with the aforementioned lips or vanes, across the inside surface during assembly. The female plate 1 includes a planar first surface 14 and a second surface 15. The second surface 15 may be domed. The central recess 12 may have a circular opening at the second surface 15.

In FIG. 4 (*b*) stud head 4 along with apparel 7 has penetrated plate 1 and has been guided into position in the direction of the arrow where the aforementioned lips or vanes 6 have flexed to allow the said stud head past at an angular position of travel in the direction of the arrow, along the length of the major axis of the orifice 5*a*. Lips or vanes 6 have then flexed back into position together under the hemispherical lipped stud head 4 to snap-fit and secure apparel 7 and event identification number 8.

In FIG. 5 stage one of the three stage assembly sequence features plate 2 being offered in the direction of the arrow event identification number 8. Stage two of the assembly sequence features plate 1 being offered in the direction of the arrow to locate over stud head 4, which has pushed apparel 7 through the hole in the event identification number 8. Stage three of the assembly sequence features stud head 4 snap-fitted over lip or vanes 6 in plate 1, thereby securing both apparel 7 and event identification number 8.

In FIG. 5*a* a top plan and cross sectional view of an alternative embodiment is featured whereby the lipped vane of plate 10, form a different configuration. Such lip or vane 11 are molded on the connecting inside face of plate 10 with the event identification number 8 and apparel 7 to facilitate further flex if needed when stud head 4 is pushed through orifice 5*a*. Further modifications are made to the inside edges of the orifice as shown such that a tapered edge and scalloped top will allow for easy entry and lock-down respectively during assembly thus securing in place the identification event number to a competitor's or participant's apparel as shown in FIG. 5*b*.

Whereupon in FIG. 5*b* a top plan and cross sectional view of an alternative embodiment is shown featuring lipped vane 11, in a different configuration, flexing to allow stud head 4 past at an angular position of travel along the length of the major axis of the orifice 5*a* in the direction of the arrow. Lip or vane 11 then flexes back into position together under the hemispherical lipped stud head 4 to snap-fit and lock over the solid none flexible edge of plate 10 securing apparel 7 and event identification number 8.

In FIG. 6 an exploded assembly view of an alternative embodiment is depicted whereby the male and female plates, 1 and 2 respectively, are permanently connected via a flexible link. Such a method is well-known in the prior art as an integral polymer or live hinge. In the case of the present invention the two parts of the assembly are functional elements which when closed together are designed to snap-fit and lock to apparel, without piercing or damaging the apparel. In the three stepped approach to assembly in FIG. 6, step 1 shows the apparel 7 with plate 2 being offered up for connection in the direction of the arrow. In step 2 stud head 4 has pushed apparel 7 through the of plate 1 to snap fit. In step 3 plate 1 has hinged in a radius about flexible connection 18 with the flexible lip or vane of plate 1 snap-fitting over stud head 4 to snap-lock over apparel 7. Plates 1 and 2 could be any shape or be integrated with a device e.g. a nurses watch or form of identification e.g. for conferences and exhibitions.

In a third embodiment, as depicted in FIG. 7, there is provided an alternative female plate which features a tapered circular orifice 20. When elliptical stud head 19 is offered up for connection as described in FIG. 3 the stud head flexes and deforms locking together the assembly of a participant's or competitor's number 8 and an athlete's apparel 7 in place without damage to the aforesaid apparel.

In a further embodiment as depicted in FIG. 8 there is provided a plurality of apertures 21 in both plates 1 and 2 providing alternative attaching systems for both plates to their respective materials in the form of permanent connections. Such connections may be stitched, or sewn, or using other such like commonplace methods.

In FIG. 9 an exploded view depicts an assembly sequence showing an alternative embodiment wherein plate 2 features a flat chord segment across the perimeter to give indication for attaching and release also increasing the angle of attaching release of the female plate with no flexible lips or vanes to and from the male plate.

In a further embodiment in FIG. 10 three orifices are illustrated for use with any of the previously described figures: orifice 1 features two shaped flexible lips or vanes with a sculptured divider midway in the diameter; orifice 2 features a single crescent shaped flexible lip or vane and orifice 3 features an elliptical shape with no flexible lips or vanes.

In a further embodiment, as depicted in FIG. 11, there is provided an alternative female plate which features a different configuration of tapered circular orifice 22 consisting of a conjoined small circle blending into a larger circle. Stud head 4 is smaller than the larger circular orifice and larger than the small orifice. When stud head 4 is offered up for connection as described in FIG. 3 the stud head fits through the larger circular orifice. As the stud is shifted laterally along the major axis of the two circular orifice the stud diameter is smaller than the adjoining intersection point of the two circular orifice w herein the adjoining intersection point locks the stud from laterally shifting along the major axis of the two circles the smaller circular orifice prevents the stud head from removal as described in FIG. 3 locking together the assembly of a participant's or competitor's number 8 and an athlete's apparel 7 in place without damage to the aforesaid apparel.

Referring now to EP1634508 'System for fastening the competition numbers or "bibs" on the garment of an athlete,' and comparing and contrasting with aspects of the present invention, there is observed no allowance for differences in material thicknesses of an athlete's apparel provided in EP1634508 in the description or claims. Such allowance for material thickness, although small, is essential to provide a snap fit of the two attaching plates and to provide a definite physical or audible indication of connection to the wearer. If this were not the case as in EP1634508 there may be occasions when an athlete would assume a connection has been made only to be disappointed mid-way through a race, for example, when the identification number comes adrift. In all the embodiments of the present invention this allowance is provided for by the flexible plastic-lipped vanes first described in FIG. 3, which adjust by flexing to make allowance for varying thicknesses, folds or creases of typical apparel and participation numbers worn for sporting activities and thus facilitating a positive snap-fit connection, indicating to the athlete audibly, or in a tactile manner, or both that a secure connection has been made.

Furthermore, the disc shaped body 5 as described in EP1634508 does not have a strengthening function, which is provided for by the elastic vanes 6 in the present invention. In addition due to the coaxial activity in the shank as described therein EP1634508, the annular head of the shank is made bigger and increases the forces acting upon the fastener by the material and the deformation of the competitor's apparel. It will also be understood that as a result there would be no film indication to the user that the two halves of the fastener had connected securely. In the description the washer with the central hole requires the annular head to lock all the way around the circumference otherwise it would work loose and come apart.

By contrast with EP1634508 the present disclosure includes embodiments having one or more of the following features:

1. A single flexible vane or lip opposing a single solid edge or lip within the orifice in plate 1, a stud 3 and a stud head 4, as opposed to an annular projection or ring, in plate 2.
2. An integrated self-locking function which locks plate 1, as opposed to an automatic button operation principle.
3. Elasticated deformation lip.
4. A stud which passes through from the inside surf ace of the assembly.
5. Uses the thickness of the apparel to lock plate 1 to plate 2.

The present invention also differs by using the thickness of the apparel to lock plate 1 to plate 2.

For ergonomic reasons the dimensions of plate 1 are less than the dimensions of plate 2. Being a self-locking fastener the present invention has further uses other than attaching sporting identification event numbers without piercing or damaging a participant's or competitor's apparel. These include, dance competitions and game show events.

Referring now to the following patents, by contrast with U.S. Pat. No. 2,981,992 A, FR864346 A, FR1350098 A, NL6611411 A, GB951000 A, WO92/04837 A1 fastening systems the present disclosure includes embodiments having one or more of the following features:

1. A single flexible vane or lip opposing a single solid edge or lip in plate 1.
2. A self-locking function which locks plate 2 to plate 1.
3. Elasticated deformation lips which friction-flex.
4. A plate 2 featuring an integral stud mounting which is fanned to engage and interlock diagonally with a plate 1.
5. A plate 1 featuring a single chamfer across the perimeter to act as a hinge for angled engagement and facilitates balanced angled release of the plate 1 against the plate 2.
6. Elliptical stud head.

The present invention also differs by using the thickness of the apparel to lock plate 1 to plate 2 and can secure event numbers and other identification to apparel also a device or object.

It will be appreciated by those skilled in the art that any number of combinations of the aforementioned features and/or those shown in the appended drawings provide clear advantages over the prior art and are therefore within the scope of the invention described herein.

The foregoing description details certain preferred embodiments of the present invention and describes the best mode contemplated. It will be appreciated, however, that changes may be made in the details of construction and the configuration of components without departing from the spirit and scope of the disclosure. Therefore, the description provided herein is to be considered exemplary, rather than limiting, and the true scope of the invention is that defined by the following claims and the full range of equivalency to which each element thereof is entitled.

The invention claimed is:

1. A releasable interlocking device specifically adapted to fasten an event identification number to apparel, the device comprising:

a female plate with a planar first surface and a second surface, the female plate including a central recess in the second surface and a central orifice defined by a flexible lip and an opposing non-flexible lip at the first surface; and a male plate with an integral stud that protrudes from a planar surface and includes an overlapping domed stud head;

wherein the overlapping domed stud head is sized and configured to pass through a hole in the event identification number positioned adjacent the apparel and to push the apparel through the central orifice in the female plate, thereby deforming and engaging the flexible lip of the female plate with the stud head, and with the stud head and apparel being received in the central recess of the female plate, to fasten the event identification number to the apparel.

2. A releasable interlocking device according to claim 1, wherein the second surface of the female plate is domed.

3. A releasable interlocking device according to claim 2, wherein the central recess has a circular opening at the second surface.

4. A releasable interlocking device according to claim 3, wherein the central orifice is elliptically shaped, and the elliptically shaped central orifice is offset relative to the circular opening at the second surface.

5. A releasable interlocking device according to claim 2, wherein the central orifice is elliptically shaped.

6. A releasable interlocking device according to claim 2, wherein the peripheral edge of the female plate includes a circular first part and a straight second part that extends along a chord of the circular first part.

7. A releasable interlocking device according to claim 1, wherein the central recess has a circular opening at the second surface.

8. A releasable interlocking device according to claim 7, wherein the central orifice is elliptically shaped, and the elliptically shaped central orifice is offset relative to the circular opening at the second surface.

9. A releasable interlocking device according to claim 1, wherein the central orifice is elliptically shaped.

10. A releasable interlocking device according to claim 1, wherein the peripheral edge of the female plate includes a circular first part and a straight second part that extends along a chord of the circular first part.

11. A releasable interlocking device according to claim 1, wherein the central orifice is offset relative to said central recess defined in the second surface.

* * * * *